US008618997B2

(12) United States Patent
Kato et al.

(10) Patent No.: US 8,618,997 B2
(45) Date of Patent: Dec. 31, 2013

(54) ANTENNA MODULE AND ELECTRONIC APPARATUS

(75) Inventors: Yoshihiro Kato, Kanagawa (JP); Shinichi Fukuda, Kanagawa (JP); Kenichi Kabasawa, Saitama (JP); Yoshito Ikeda, Tochigi (JP); Keisuke Matsunami, Tokyo (JP)

(73) Assignee: Sony Corporation (JP)

( * ) Notice: Subject to any disclaimer, the term of this patent is extended or adjusted under 35 U.S.C. 154(b) by 348 days.

(21) Appl. No.: 13/065,199

(22) Filed: Mar. 16, 2011

(65) Prior Publication Data

US 2011/0234014 A1 Sep. 29, 2011

(30) Foreign Application Priority Data

Mar. 29, 2010 (JP) ..... P2010-074657

(51) Int. Cl.
*H01Q 7/08* (2006.01)

(52) U.S. Cl.
USPC ..... 343/788; 235/492; 340/572.1; 340/572.8; 340/10.3

(58) Field of Classification Search
USPC ..... 235/492; 343/788; 340/572.7, 572.8, 340/10.3
See application file for complete search history.

(56) References Cited

U.S. PATENT DOCUMENTS

2009/0160719 A1* 6/2009 Kato et al. ..... 343/742

FOREIGN PATENT DOCUMENTS

JP 2007-124557 A 5/2007
JP 2007-165141 A 6/2007

* cited by examiner

*Primary Examiner* — Kristy A Haupt
(74) *Attorney, Agent, or Firm* — Lerner, David, Littenberg, Krumholz & Mentlik, LLP

(57) ABSTRACT

Provided is an antenna module including: an antenna coil having a first pattern width; a magnetic sheet, which includes a first surface on which the antenna coil is to be arranged, and has a first distance being a distance on the first surface between an edge of the first surface and the antenna coil, the first distance being twice or more as large as the first pattern width; and a conductor, which includes a second surface on which the magnetic sheet is to be arranged while a surface opposite to the first surface of the magnetic sheet faces the second surface, and has a second distance being a distance on the second surface between an edge of the second surface and the antenna coil, the second distance being equal to or larger than the first distance.

7 Claims, 17 Drawing Sheets

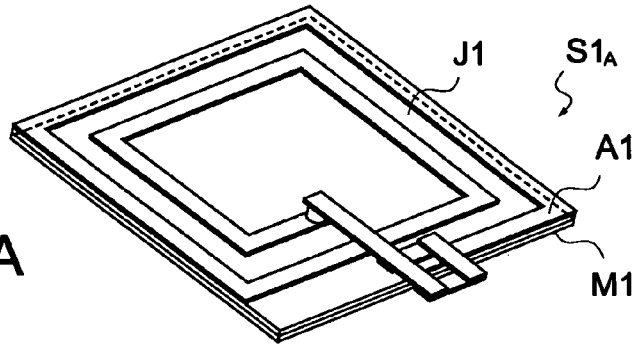
FIG.4A
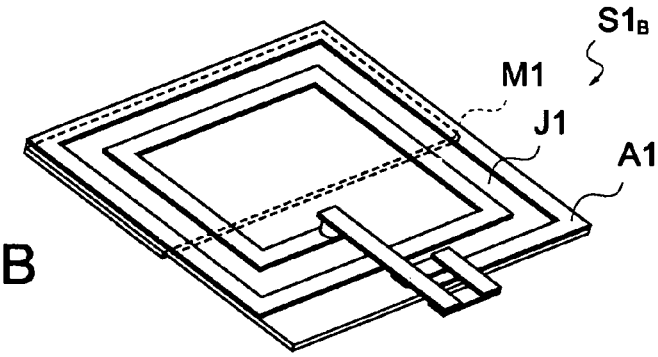
FIG.4B
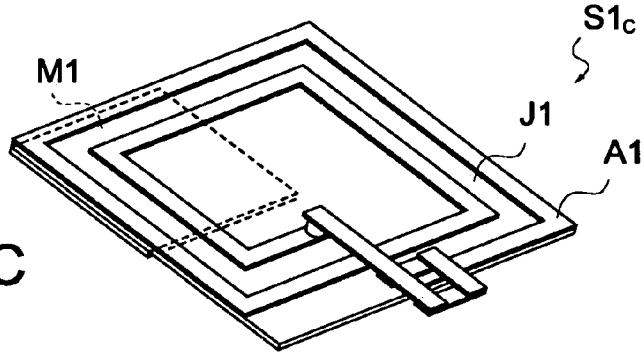
FIG.4C
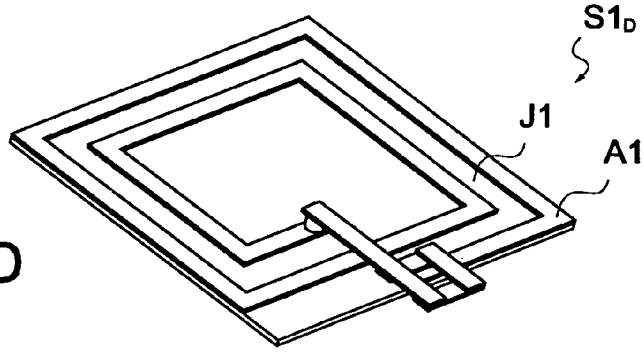
FIG.4D
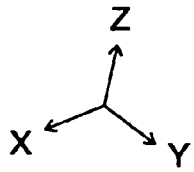

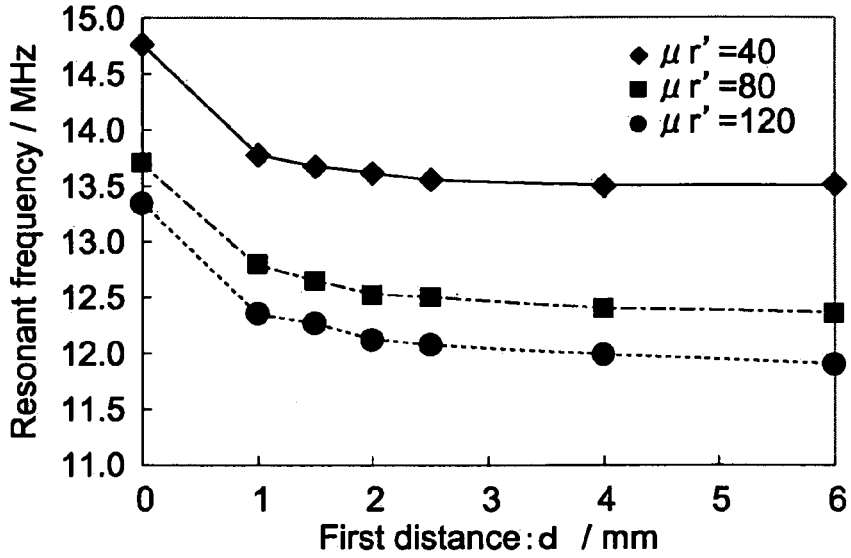
FIG.9
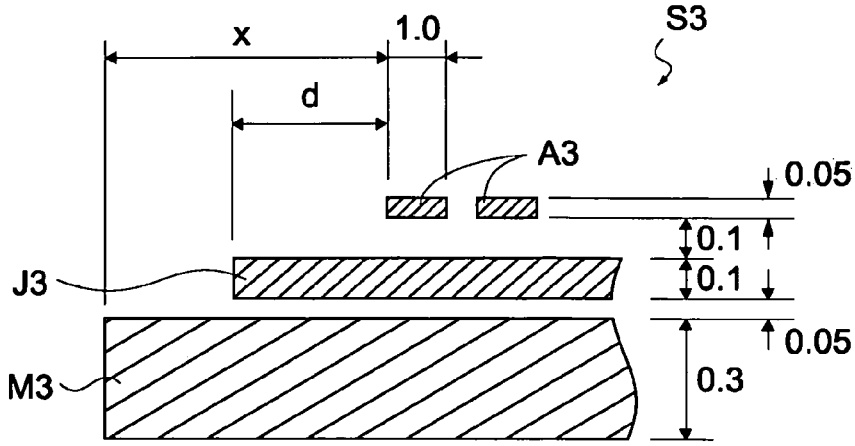
FIG.10
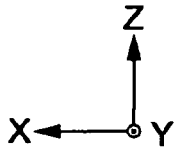

| Model | First distance d (mm) | Second distance x (mm) | Resonant frequency (MHz) |
|---|---|---|---|
| $S3_A$ | 0.0 | 0.0 | 14.32 |
| $S3_B$ | 0.0 | 10.0 | 14.76 |
| $S3_C$ | 2.0 | 2.0 | 13.54 |
| $S3_D$ | 2.0 | 10.0 | 13.62 |
| $S3_E$ | 4.0 | 4.0 | 13.50 |
| $S3_F$ | 4.0 | 10.0 | 13.50 |

ANTENNA MODULE AND ELECTRONIC APPARATUS

CROSS-REFERENCE TO RELATED APPLICATION

The present application claims priority from Japanese Patent Application No. JP 2010-074657 filed in the Japanese Patent Office on Mar. 29, 2010, the entire content of which is incorporated herein by reference.

BACKGROUND OF THE INVENTION

1. Field of the Invention

The present invention relates to an antenna module installing an antenna coil having a resonant frequency, and to an electronic apparatus installing the above-mentioned antenna module.

2. Description of the Related Art

Non-contact communication systems, which are called radio frequency identifications (RFIDs), are now in widespread use. As a non-contact communication method used in the RFID system, there can be exemplified a capacitive coupling method, an electromagnetic induction method, and a radio wave communication. Among them, the RFID system using the electromagnetic induction method is, for example, constituted of a first coil on a reader/writer side and a second coil on a transponder side. A data communication via the coils is performed by a magnetic coupling of the above-mentioned two coils.

Specifically, the reader/writer amplitude-modulates the magnetic field generated in the first coil so as to transmit data, and the transmitted data is detected on the transponder side. Further, the transponder performs a modulation process such as an amplitude modulation through a load switching (LS) of the second coil so as to transmit the data to the reader/writer.

The antenna coils of the transponder and the reader/writer each operate as an LC resonant circuit. In general, the resonant frequency of those coils is adjusted to be a carrier frequency of a carrier wave for communication and is resonated to set an appropriate communication distance between the transponder and the reader/writer.

Further, also non-contact power supply (non-contact power transmission, wireless power transmission) systems have received attention in recent years. As a power transmission method used in the non-contact power supply system, there can be exemplified an electromagnetic induction method and an electromagnetic resonance method. The electromagnetic induction method utilizes the same principle as previously described in the RFID system. Specifically, the magnetic field generated when current is supplied to the first coil is used to supply the electric power to the second coil. On the other hand, the electromagnetic resonance method includes an electric field coupling and a magnetic field coupling, and performs a power transmission by a coupling of the electric field or the magnetic field utilizing a resonance. In particular, the electromagnetic resonance method utilizing the magnetic field coupling has attracted attention in recent years, and the resonance antennae thereof are designed with coils.

In view of the above-mentioned principle, in the RFID system and the non-contact power supply system, a resonance design for the coil of the antenna portion (hereinafter, referred to as antenna coil) is very important. Even if the antenna coil itself is designed to resonate at a desired frequency, when the antenna coil is actually implemented in the electronic apparatus, magnetic field components generated from the antenna coil may be affected by metal located in the periphery of the antenna coil. Therefore, it is difficult for the antenna coil to exert the desired property. That is caused due to the fact that the magnetic field generated from the antenna coil interferes (is coupled to) the metal located in the periphery of the antenna coil with a result that inductance components of the coil is decreased and the resonant frequency is shifted and that eddy-current loss occurs.

As one of the countermeasures, a magnetic sheet has been utilized. When the magnetic sheet is provided between the antenna coil and the metal located in the periphery of the antenna coil, the magnetic fluxes generated from the antenna coil are collected in the magnetic sheet. Thus, the interference with respect to the metal is decreased. It should be noted that there is a limitation on thickness of the magnetic sheet for the tendency of downsizing or thinning the electronic apparatus and it is difficult to ensure a sufficient sheet thickness, and hence the magnetic sheet is incapable of completely eliminating the interference of the magnetic field with respect to the metal. Therefore, it is necessary to coordinate a resonance circuit design in order to achieve a desired property when implemented in the electronic apparatus, considering various combinations including the position at which the metal to be arranged in the electronic apparatus, the position of the antenna coil, the magnetic permeability property and the thickness of the magnetic sheet, and the like.

In the electronic apparatus, a battery is exemplified as one of the metal parts that exert the most effect on the antenna coil. When the battery, the antenna coil, and the magnetic sheet are implemented in the electronic apparatus as separate components, the coordination described above needs to be considered in the implementation phase. However, if the battery, the antenna coil, and the magnetic sheet are integrated as one component, positional relation between the battery, the antenna coil, and the magnetic sheet when implemented in the electronic apparatus can be grasped. Thus, even after the implementation, the resonant frequency of the antenna coil, which is adjusted before the implementation, is not largely changed, and hence it is unnecessary to substantially readjust the resonant frequency of the antenna coil during the implementation.

For example, Japanese Patent Application Laid-open No. 2007-124557 (Paragraph [0025], FIG. 3) (hereinafter, referred to as Patent Document 1) and Japanese Patent Application Laid-open No. 2007-165141 (Paragraph [0016], FIG. 5) (hereinafter, referred to as Patent Document 2) each have proposed a structure in which the antenna coil and the battery are integrated.

In Patent Document 1, a magnetic material having a frame shape or a band shape is arranged so as to surround the outer surface of the battery, and the antenna coil is wound on the outer surface of the magnetic material. Further, in Patent Document 2, a battery case is formed of a resin including magnetic filler, and the antenna coil is wound around the battery case.

SUMMARY OF THE INVENTION

However, in the configuration described in Patent Document 1, for example, in a case of a typical battery having a cuboid shape, the antenna coil is wound on the outer periphery of the battery, and hence the antenna coil is arranged over four surfaces of the battery. In this case, even if the interference between the antenna coil and the battery can be prevented, interference between four surfaces of the battery and other metals needs to be considered. Meanwhile, in the configuration described in Patent Document 2, the battery case is provided for housing the battery. It can be said that this battery case structure is the same as the structure in which the magnetic sheet is arranged on large part of the outer surface of the battery. In addition, the cost can be significantly increased.

In view of the circumstances as described above, there is a need for providing an antenna module, the resonant frequency of which is prevented from being changed due to a metal part located in the periphery of the antenna module, and an electronic apparatus installing the above-mentioned antenna module.

According to an embodiment of the present invention, there is provided an antenna module including an antenna coil, a magnetic sheet, and a conductor.

The antenna coil has a first pattern width.

The magnetic sheet includes a first surface on which the antenna coil is to be arranged, and has a first distance being a distance on the first surface between an edge of the first surface and the antenna coil, the first distance being twice or more as large as the first pattern width.

The conductor includes a second surface on which the magnetic sheet is to be arranged while a surface opposite to the first surface of the magnetic sheet faces the second surface, and has a second distance being a distance on the second surface between an edge of the second surface and the antenna coil, the second distance being equal to or larger than the first distance.

In the conductor, the second distance is set to be larger than the first distance, and hence it is possible to shut out the interference of an object located on the back surface of the antenna coil with respect to the antenna coil. In addition, in the magnetic sheet, the first distance is set to be twice or more as large as the first pattern width, and hence it is possible to shut out the interference of the conductor with respect to the antenna coil. With this, it is possible to prevent the resonant frequency from being changed due to the interference of a metal part provided to an electronic apparatus main body with respect to the antenna coil when the antenna module is installed in the electronic apparatus main body.

The conductor may include a battery.

Typically, the battery for use of the electronic apparatus includes the conductor having a relatively large area. Therefore, when the battery is provided with the antenna coil and the magnetic sheet, the above-mentioned antenna module can be obtained.

The first distance may be 4 times or more as large as the first pattern width.

By setting the first distance to be 4 times or more as large as the first pattern width, it is possible to completely prevent the interference of the conductor with respect to the antenna coil.

The antenna coil may include an antenna coil for radio frequency identification.

In the radio frequency identification (RFID) transmission, the communication efficiency is significantly lowered due to the difference in resonant frequency. Therefore, by preventing the resonant frequency from being changed according to the above-mentioned configuration, it is possible to perform a communication at optimal communication efficiency.

The antenna coil may include an antenna coil for non-contact power transmission.

In the non-contact power transmission, the transmission efficiency is significantly lowered due to the difference in resonant frequency. Therefore, by preventing the resonant frequency from being changed according to the above-mentioned configuration, it is possible to perform a power transmission at optimal transmission efficiency.

According to another embodiment of the present invention, there is provided an electronic apparatus including an antenna module and an electronic apparatus.

The antenna module includes: an antenna coil having a first pattern width; a magnetic sheet, which includes a first surface on which the antenna coil is to be arranged, and has a first distance being a distance on the first surface between an edge of the first surface and the antenna coil, the first distance being twice or more as large as the first pattern width; and a conductor, which includes a second surface on which the magnetic sheet is to be arranged while a surface opposite to the first surface of the magnetic sheet faces the second surface, and has a second distance being a distance on the second surface between an edge of the second surface and the antenna coil, the second distance being equal to or larger than the first distance.

In the electronic apparatus main body, the antenna module is to be installed.

According to the above-mentioned configuration, even when the antenna module having an adjusted resonant frequency is installed in the electronic apparatus main body, it is possible to prevent the resonant frequency from being changed due to the interference of the metal part provided to the electronic apparatus main body with respect to the antenna coil. With this, the electronic apparatus is capable of performing a communication or a power transmission at optimal resonant frequency adjusted in advance.

The conductor may include a battery, and the electronic apparatus main body may be driven by the battery.

The battery is formed as a part of the antenna module, and hence another component functioning as the conductor becomes unnecessary and the number of components can be reduced.

According the embodiments of the present invention, it is possible to provide an antenna module, the resonant frequency of which is prevented from being changed due to a metal part located in the periphery of the antenna module, and an electronic apparatus installing the above-mentioned antenna module.

These and other objects, features and advantages of the present invention will become more apparent in light of the following detailed description of best mode embodiments thereof, as illustrated in the accompanying drawings.

BRIEF DESCRIPTION OF DRAWINGS

FIG. 4 are pattern diagrams of first simulation models;

FIG. 9 is a graph showing results of analysis of the second simulation model;

FIG. 10 is a sectional view of a third simulation model;

DESCRIPTION OF PREFERRED EMBODIMENTS

Hereinafter, embodiments of the present invention will be described with reference to the drawings.

[Configuration of Antenna Module]

Figure 1:
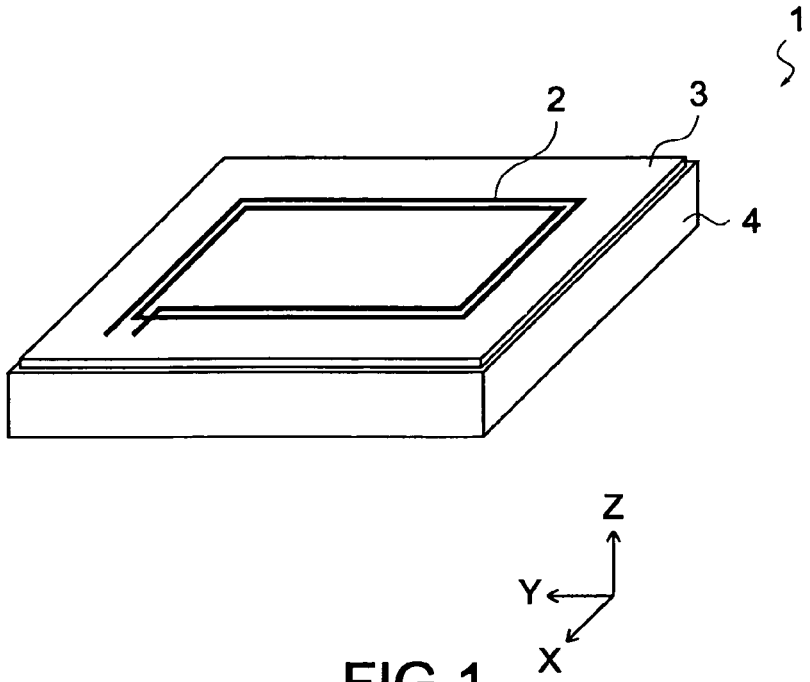
FIG. 1 is a perspective view of an antenna module.
Figure 2:
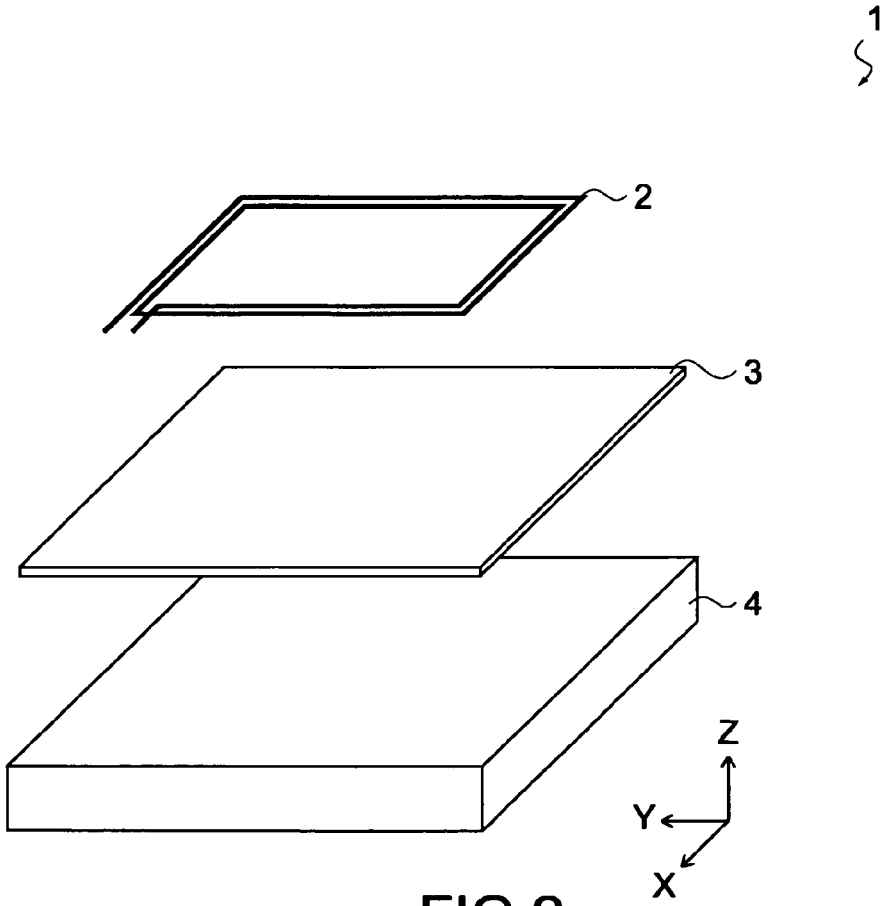
FIG. 2 is a exploded perspective view of the antenna module.
Figure 3:
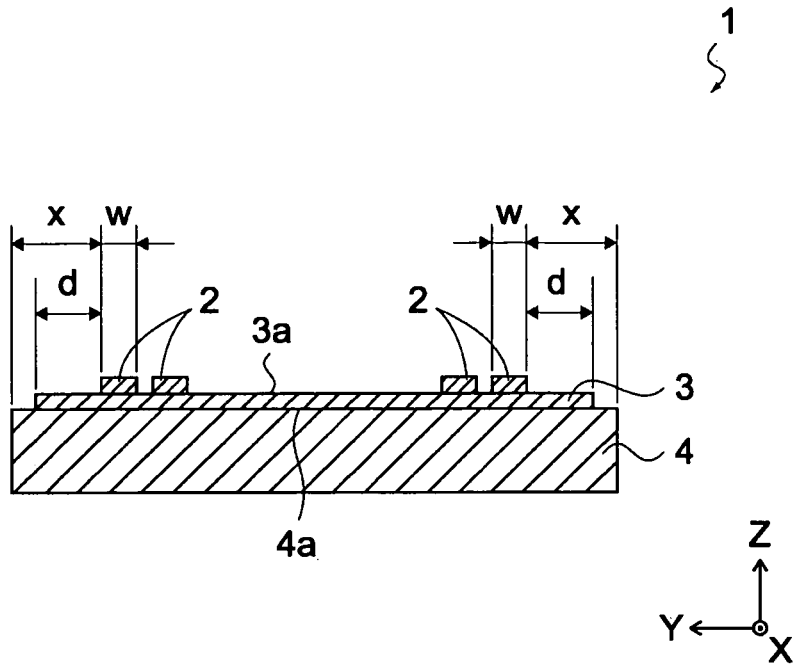
FIG. 3 is a sectional view of the antenna module.

FIG. 1 is a perspective view showing an antenna module 1 according to an embodiment of the present invention. FIG. 2 is an exploded perspective view showing a configuration of the antenna module 1. Further, FIG. 3 is a sectional view of the antenna module 1.

As shown in those drawings, the antenna module 1 includes an antenna coil 2, a magnetic sheet 3, and a battery 4. The antenna coil 2, the magnetic sheet 3, and the battery 4 are stacked in the stated order. Here, a direction in which the antenna coil 2, the magnetic sheet 3, and the battery 4 are stacked is denoted by a Z-direction, a direction orthogonal to the Z-direction is denoted by an X-direction, and a direction orthogonal to the X-direction and the Z-direction is denoted by a Y-direction.

The antenna coil 2 is a lead being two-dimensionally wound in a coiled form. Here, the shape and the number of winding are arbitrarily selected. The antenna coil 2 can be one that is obtained by punching out a printed circuit board using an flame retardant type 4 (FR4) and the like, a flexible printed circuit board using polyimide and the like, or a metal thin board. The antenna coil 2 can be attached to the magnetic sheet 3 with use of an adhesive tape. Further, the antenna coil 2 may be one that is formed on the magnetic sheet 3 by plating or deposition.

The antenna coil 2 constitutes an LC resonant circuit together with a circuit located in the periphery of the antenna coil 2, and transmits and receives an electromagnetic wave for mediating a communication or an electric power transmission. Hereinafter, a pattern width of the lead is referred to as a first width w. In a case where the lead has not the same width over the entire length of the antenna coil 2, a width of the lead located in the outermost periphery of the lead pattern is selected as the first width w.

The magnetic sheet 3 is arranged between the battery 4 and the antenna coil 2, and prevents metal contained in the battery 4 from interfering (being coupled to) the magnetic field generated from the antenna coil 2. The magnetic sheet 3 can be one that is constituted of a sintered body of Mn—Zn-based ferrite, Ni—Zn-based ferrite, Ni—Zn—Cu-based ferrite, Cu—Zn-based ferrite, Cu—Mg—Zn-based ferrite, Mn—Mg—Al-based ferrite, YIG-based ferrite, or the like. Alternatively, the magnetic sheet 3 may be one that is constituted of a composite obtained by mixing, for example, Fe, Co, Fe—Al—Si-based, Fe—Si—Cr-based, Fe—Si-based, Fe—Ni-based, Fe—Co-based, Fe—Co—Ni-based, or Fe—Cr-based magnetic metal powders into a resin, or a composite obtained by mixing powders of the above-mentioned ferrite material into a resin.

The magnetic sheet 3 includes a first surface 3*a* on which the antenna coil 2 is provided and a back surface opposite to the first surface 3*a*. The magnetic sheet 3 can be one that includes the back surface thereof to be attached to the battery 4 with use of the adhesive tape. As shown in FIG. 3, a distance on the first surface 3*a* between each of edges of the first surface 3*a* and the antenna coil 2 is referred to as the first distance d. The magnetic sheet 3 is formed in such a manner that the first distance d is twice or more as large as the above-mentioned first width w.

The battery 4 is a battery for an electronic apparatus such as a cellular phone or a portable information terminal in which the antenna module 1 according to this embodiment is installed. It should be noted that the antenna module 1 according to this embodiment is not necessarily installed to the cellular phone or the portable information terminal, and the antenna module 1 may be installed into a mobile body such as a vehicle. The battery 4 includes a member made of metal, to thereby shut out interference with respect to the antenna coil 2 due to a metal part provided to the electronic apparatus. A surface, on which the magnetic sheet 3 is attached, of the battery 4 is referred to as a second surface 4*a*. Further, a distance on the second surface 4*a* between each of edges of the second surface 4*a* and the antenna coil 2 is referred to as a second distance x. The battery 4 is formed in such a manner that the second distance x is equal to or larger than the above-mentioned first distance d. It should be noted that the battery 4 may be coated with a synthetic resin, for example.

The antenna module 1 is configured in the above-mentioned manner. A relation between the first width w, the first distance d, and the second distance x is expressed by the following (Expression 1).

$$x \geq d \geq 2w \qquad \text{(Expression 1)}$$

In a case where the first width w, the first distance d, and the second distance x comply with (Equation 1), when the antenna module 1 is implemented in the electronic apparatus, it is possible to prevent the interference of the metal incorporated in the electronic apparatus with respect to the antenna coil 2, to thereby prevent the resonant frequency from being changed, which will be described in the following.

[Effect on Resonant Frequency Depending on Size of Conductor]

Under a state in which the antenna coil is provided with the magnetic sheet, it may be impossible for only the magnetic sheet to absorb all magnetic fluxes generated from the antenna coil. As a result, interference between the antenna coil and the conductor located in the periphery of the antenna coil occurs. The fact that the degree of the interference varies depending on the size of the conductor will be described later with reference to simulation analyses.

Figure 5:
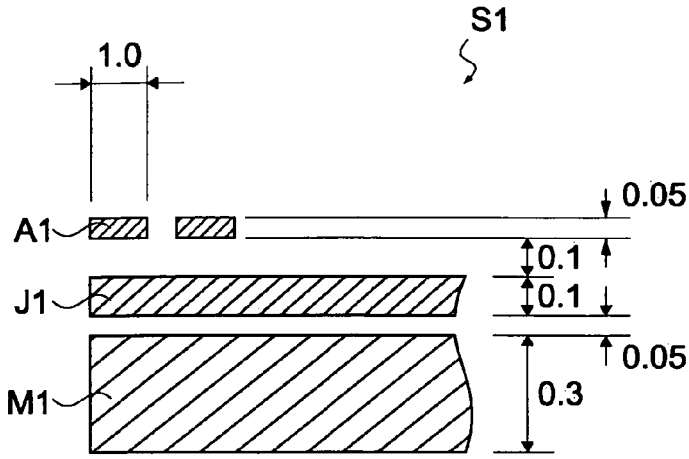
FIG. 5 is a sectional view of one of the first simulation models.
Figure 5:
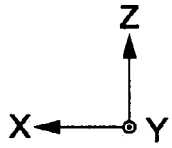

FIG. 4 is pattern diagrams of first simulation models S1. FIG. 5 is a sectional view of one of the first simulation model S1. As shown in those drawings, each of the first simulation models S1 includes a metal plate M1, a magnetic sheet J1, and an antenna coil A1, which are stacked in the stated order. As shown in FIGS. 4A to 4D, the first simulation models S1 have metal plates M1 different in size (presence or absence). Hereinafter, the first simulation model S1 shown in FIG. 4A is referred to as a model S1A, the first simulation model S1 shown in FIG. 4B is referred to as a model S1B, the first simulation model S1 shown in FIG. 4C is referred to as a model S1C, and the first simulation model S1 shown in FIG. 4D is referred to as a model S1D.

Both of the metal plate M1 and the antenna coil A1 were made of copper. The magnetic sheet M1 was set to have a predetermined magnetic complex permeability. The magnetic complex permeability includes a real part μr' and an imaginary part μr". The real part μr' is associated with a magnetic flux density component in the same phase as that of the magnetic field. The imaginary part μr" is an index including a delay of the phase and corresponds to a loss of magnetic energy. In this case, the real part μr' was set to 80, and the imaginary part μr" was set to 0.

The width (X-direction or Y-direction) of the antenna coil A1 was set to 1.0 mm and the thickness (Z-direction) of the antenna coil A1 was set to 0.05 mm. Further, the size of the magnetic sheet J1 was set to 15.0 mm, 14.5 mm, and 0.1 mm (X-direction, Y-direction, and Z-direction). The size of the metal plate M1 was set as follows: the model S1A: 15.0 mm, 14.5 mm, 0.3 mm (X-direction, Y-direction, and Z-direction); the model S1B: 15.0 mm, 7.25 mm, 0.3 mm (X-direction, Y-direction, and Z-direction); the model S1C: 7.5 mm, 7.25 mm, 0.3 mm (X-direction, Y-direction, and Z-direction); and the model S1D: no metal plate M1. The interval between the antenna coil A1 and the magnetic sheet J1 was set to 0.1 mm, and the interval between the magnetic sheet J1 and the metal plate M1 was set to 0.05 mm.

Figure 6:
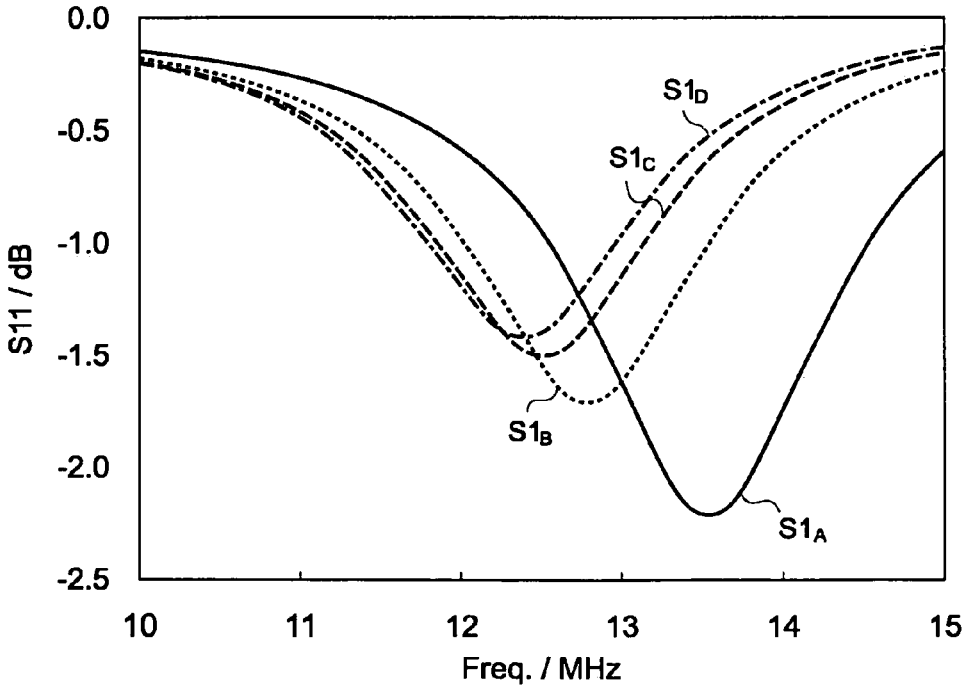
FIG. 6 is a graph showing results of analysis of the first simulation model.

FIG. 6 is a graph showing results of this simulation analysis. The horizontal axis denotes a frequency, and the vertical axis denotes an S11 property. The S11 property refers to one of S-parameters expressing properties of transmission and reflection of the electric power in the circuit, and specifically, to a ratio of the electric power reflected on an input terminal with respect to the electric power input into the input terminal. In each plot, a frequency having the smallest S11 property corresponds to the resonant frequency.

As can be seen in FIG. 6, as the size of the metal plate M1 becomes larger, the resonant frequency becomes higher. That is because the interference occurs between the magnetic field components, which are generated from the antenna coil A1, and the metal plate M1. As the size of the metal plate M1 becomes larger, the degree of the interference is increased with a result that inductance components are reduced. As the model S1A is compared to the model S1D, a shift of 1 MHz or more of the resonant frequency can be seen.

The graph shows that it may be impossible to prevent the interference of the magnetic field from the metal to the antenna coil only by arranging the magnetic sheet on the back surface of the antenna coil, and that when the antenna coil is implemented into the electronic apparatus, it is necessary to readjust the resonant frequency by changing the shape or the position of the metal located in the periphery of the antenna coil, or the like. Further, in a case where there is a limitation on thickness of the magnetic sheet for the purpose of downsizing or thinning the electronic apparatus, it is conceivable that the degree of the interference between the antenna coil and the metal is further increased.

[Optimal Arrangement of Antenna Coil, Magnetic Sheet, and Battery]

Figure 7:
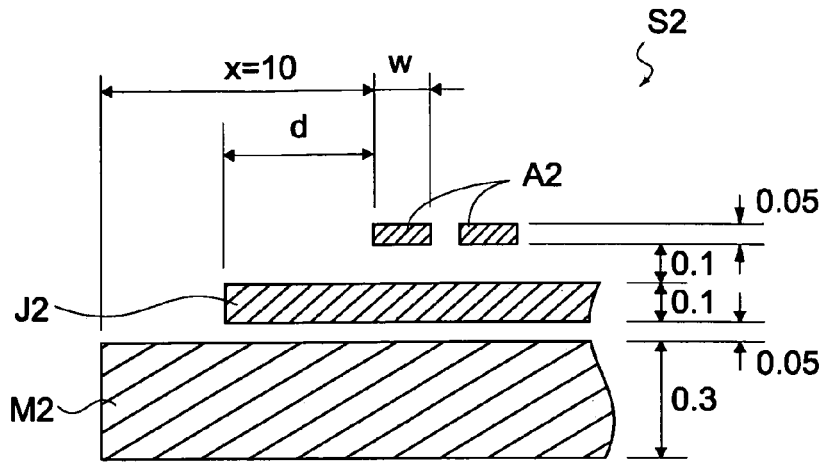
FIG. 7 is a sectional view of a second simulation model.
Figure 7:
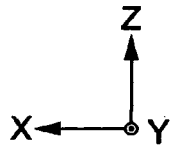

Then, the optimal arrangement of the antenna coil, the magnetic sheet, and the battery was considered, using a simulation model. FIG. 7 is a schematic sectional view of a second simulation model S2. The second simulation model S2 includes, similarly to the first simulation models S1, an antenna coil A2, a magnetic sheet J2, and a metal plate M2 stacked in the stated order. The metal plate M2 was set to have such a size that the second distance x thereof was equal to 10 mm. Using the second simulation model S2, the resonant frequency was analyzed for each magnetic complex permeability (real part μr'=40, 80, 100) of the magnetic sheet J2 while changing the size (first distance d) of the magnetic sheet J2 with respect to the width of the antenna coil A2 (first width w). It should be noted that the imaginary part μr" of the magnetic complex permeability of the magnetic sheet J2 is equal to 0.

Figure 8:
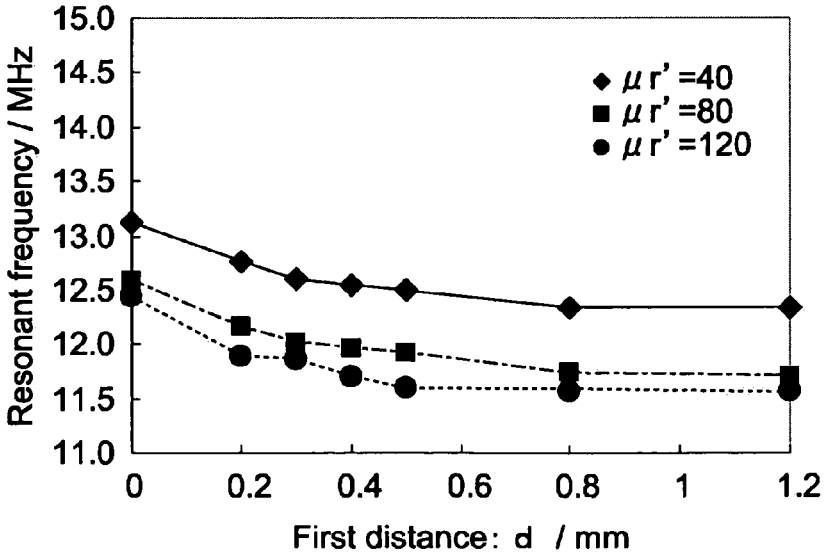
FIG. 8 is a graph showing results of analysis of the second simulation model.

FIG. 8 and FIG. 9 are graphs showing results of analysis, and plots of the resonant frequency with respect to the first distance d. FIG. 8 shows a case where the first width w is equal to 0.2 mm, and FIG. 9 shows a case where the first width w is equal to 1.0 mm. As can be seen in FIG. 8 and FIG. 9, with increase of the first distance d, the amount of change of the resonant frequency is decreased. This tendency is not changed even if the real part μr' is changed.

Further, approximately from the value at which the first distance d is twice as large as the first width w (0.4 mm in FIG. 8, 2.0 mm in FIG. 9), the change of amount of the resonant frequency is particularly small. Further, approximately from the value at which the first distance d is 4 times as large as the first width w (0.8 mm in FIG. 8, 4.0 mm in FIG. 9), the change of amount of the resonant frequency is substantially equal to 0.

Further, an effect on the resonant frequency depending on the size of the magnetic sheet (first distance d) and the size of battery (second distance) was considered, using a simulation model. FIG. 10 is a schematic sectional view of a third simulation model S3. The third simulation model S3 includes, similarly to the first and second simulation models S1 and S2, an antenna coil A3, a magnetic sheet J3, and a metal plate M3 stacked in the stated order. The width of the antenna coil A3 (first width w) was set to 1.0 mm, and the magnetic complex permeability of the magnetic sheet J3 was set to have the real part μr'=40 and the imaginary part μr"=0. Using the third simulation model S3, the resonant frequency was analyzed while changing the first distance d and the second distance x.

The first distance d and the second distance x of the third simulation model S3 are as follows.

Figures 11, 12:
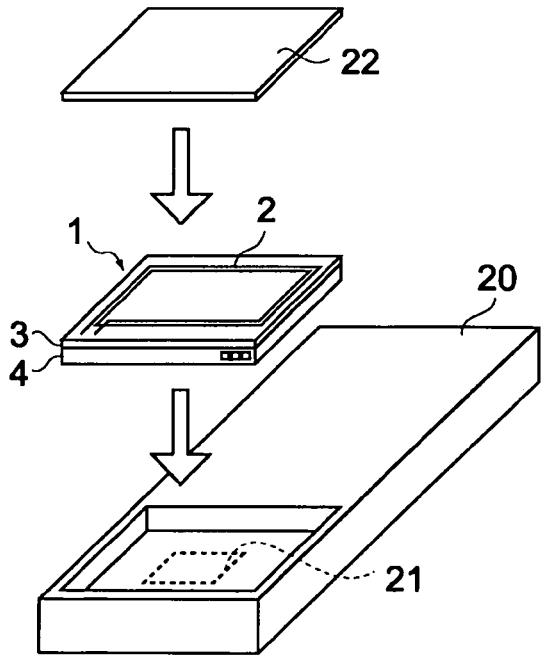
FIG. 11 is a graph showing results of analysis of the third simulation model.
FIG. 12 is a pattern diagram showing how to implement the antenna module into an electronic apparatus main body.

Model S3A: d=0.0 mm, x=0.0 mm
Model S3B: d=0.0 mm, x=10.0 mm
Model S3C: d=2.0 mm, x=2.0 mm
Model S3D: d=2.0 mm, x=10.0 mm
Model S3E: d=4.0 mm, x=4.0 mm
Model S3F: d=4.0 mm, x=10.0 mm FIG. 11 is a graph showing results of analysis. As shown in FIG. 11, in a case where the first distance d is equal to 0.0 mm (model S3A, S3B), depending on the size (second distance x) of the metal plate M3 arranged on the back surface of the magnetic sheet J3 (second distance x), the resonant frequency is shifted. On the other hand, it can be seen that in a case where the first distance d is equal to 2.0 mm (first width w×2) (model S3C, S3D), the shift of the resonant frequency is small. In addition, it can be seen that in a case where the first distance d is equal to 4.0 mm (first width w×4) (model S3E, S3F), the resonant frequency is not shifted. Thus, by setting the first distance d to be sufficiently large, it is possible to prevent the resonant frequency from being shifted irrespective of the second distance x.

Thus, it can be said that by setting the first distance d to be twice or more as large as the first width w ($d \geq 2w$), it is possible to prevent, through the magnetic sheet, the interference of the metal part located on the back surface of the magnetic sheet with respect to the antenna coil.

In consideration of the second distance x, if the first distance d is twice or more as large as the first width w, it is possible to prevent the effect on the resonant frequency due to the conductor (battery 4) located on the back surface of the magnetic sheet 3 irrespective of the second distance x. However, if the size of the battery 4 is smaller than that of the magnetic sheet 3, it may be impossible to avoid, when the antenna module 1 is implemented, the effect on the resonant frequency due to the metal part located in the periphery thereof. Therefore, in order to eliminate the effect of the metal part as described above, the battery 4 needs to have a size larger than that of the magnetic sheet 3. In other words, the second distance x needs to be equal to or larger than the first distance d ($x \geq d$).

In summary, in a case where the second distance x is equal to or larger than the first distance d, the battery 4 prevents the interference of the metal part located on the back surface with respect to the antenna coil 2. Further, in a case where the first distance d is twice or more as large as the first width w, the magnetic sheet 3 prevents the interference of the battery 4 with respect to the antenna coil 2. That is, the first width w, the first distance d, and the second distance x comply with the relation of $x \geq d \geq 2w$, it is possible to prevent the effect on the antenna coil 2 due to the metal part located in the periphery of the antenna coil 2, that is, the shift of the resonant frequency.

[Implementation of Antenna Module into Electronic Apparatus]

FIG. 12 is a diagram showing how to implement the antenna module 1 into an electronic apparatus main body 20.

The electronic apparatus main body 20 is one that is driven by the battery, for example, a cellular phone or a portable information terminal. As schematically shown in FIG. 12, the electronic apparatus main body 20 is provided with a metal part 21. A cover 22 is a cover for covering the antenna module 1 installed in the electronic apparatus main body 20.

The antenna module 1 is installed in the electronic apparatus main body 20 in such a state that the antenna coil 2 side is oriented to the outside (cover 22 side). At this time, the battery 4 and the antenna coil 2 are electrically connected to the electronic apparatus main body 20. The interference of the metal part 21 with respect to the antenna coil 2 is shut out through the battery 4, the resonant frequency of the antenna coil 2 is prevented from being changed when the antenna module 1 is installed in the electronic apparatus main body 20. Therefore, only by installing in the electronic apparatus main body 20 the antenna module 1 including the antenna coil 2 having the resonant frequency adjusted in advance, it is possible to construct an optimal environment for the antenna coil 2.

With this, for example, even in a case where the antenna module 1 is installed in different types of electronic apparatuses different in structure, it is unnecessary to adjust the resonant frequency depending on types of electronic apparatuses. Further, in the antenna module 1, the battery 4, the antenna coil 2, and the magnetic sheet 3 are integrated into one component, and hence the number of components can be reduced.

In the following, the antenna module 1 and a circuit configuration of the electronic apparatus main body 20 will be described with reference to examples of RFID systems and non-contact power supply systems.

[RFID System Example 1]

Figure 13A:
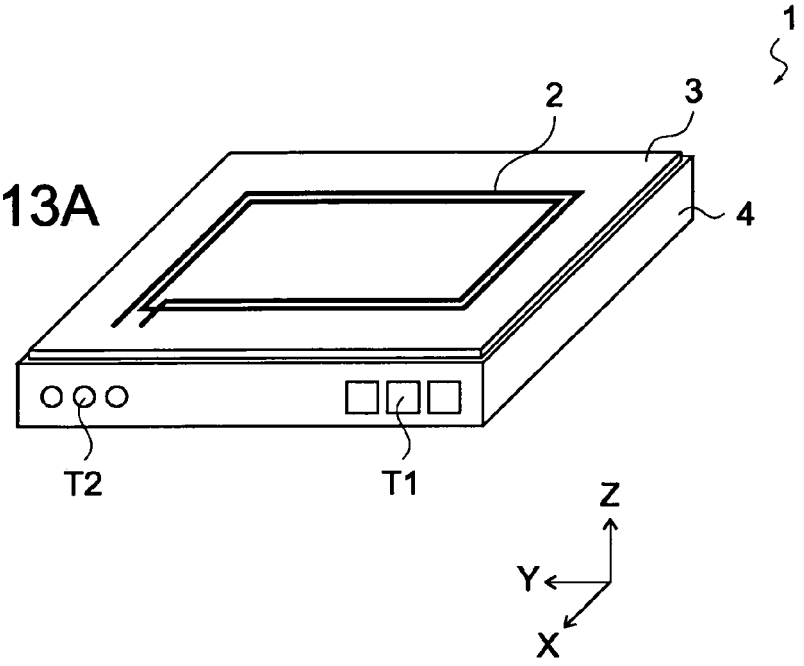
FIG. 13 are a perspective view showing an antenna module according to an RFID system example 1 and a block diagram showing a circuit configuration.
Figure 13A:
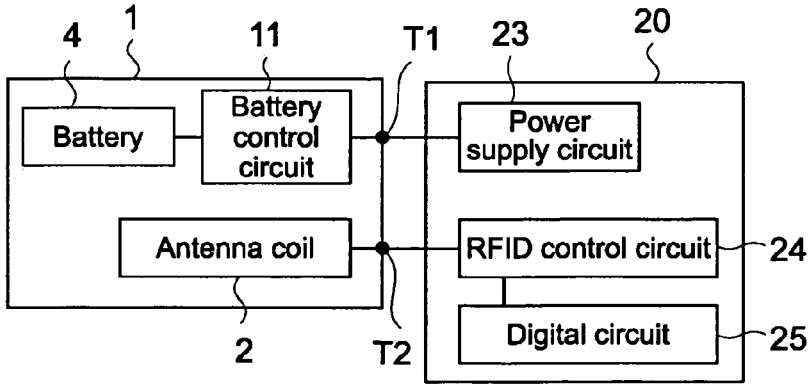

FIG. 13A is a perspective view showing the antenna module 1 in this example. As shown in FIG. 13A, the antenna module 1 is provided with a terminal T1 and a terminal T2.

FIG. 13B is a block diagram showing the circuit configuration of the antenna module 1 and the electronic apparatus main body 20 in this example. As shown in FIG. 13B, the antenna module 1 includes, in addition to the battery 4 and the antenna coil 2, a battery control circuit 11. The electronic apparatus main body 20 includes a power supply circuit 23, an RFID control circuit 24, and a digital circuit 25.

In the antenna module 1, the battery 4 is connected through the battery control circuit 11 to the terminal T1, and the antenna coil 2 is connected to the terminal T2. In the electronic apparatus main body 20, the power supply circuit 23 is connected to a terminal corresponding to the terminal T1, and the RFID control circuit 24 is connected to a terminal corresponding to the terminal T2. Further, the RFID control circuit 24 is connected to the digital circuit 25.

When the antenna module 1 is connected to the electronic apparatus main body 20, the battery 4 supplies electric power through the battery control circuit 11 to the power supply circuit 23. Then, the power supply circuit 23 generates, from the electric power supplied from the battery 4, electric power to be used for driving the electronic apparatus main body 20. The RFID control circuit 24 converts signals supplied from the digital circuit 25 into current for the antenna coil 2, or converts current supplied from the antenna coil 2 into digital signals.

As described above, the antenna module 1 of this example supplies the electric power of the battery 4 via the terminal T1 to the electronic apparatus main body 20, and transmits and receives signals for the RFID with respect to the electronic apparatus main body 20 via the terminal T2.

[RFID System Example 2]

Figure 14A:
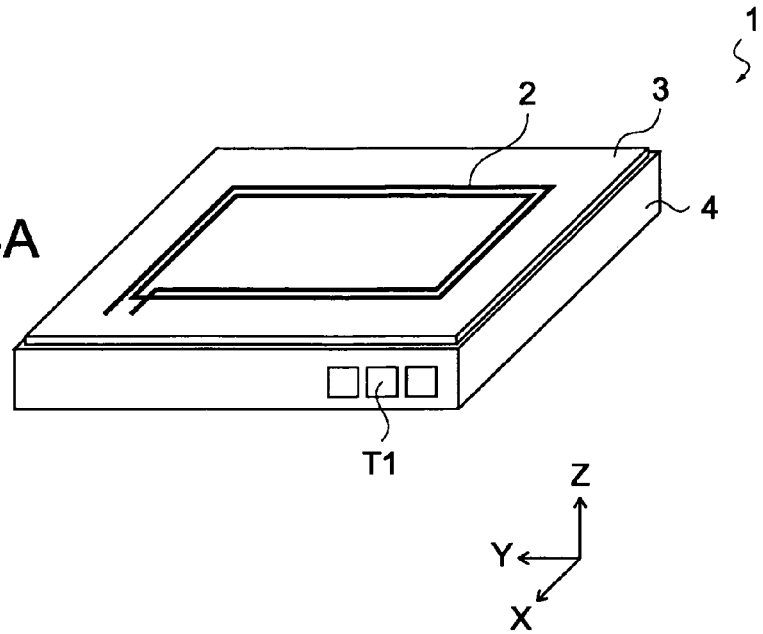
FIG. 14 are a perspective view showing an antenna module according to an RFID system example 2 and a block diagram showing a circuit configuration.

FIG. 14A is a perspective view showing the antenna module 1 in this example. As shown in FIG. 14A, the antenna module 1 is provided with a terminal T1. The terminal T1 is divided into a power supply terminal, a ground terminal, and a control system terminal.

Figure 14B:
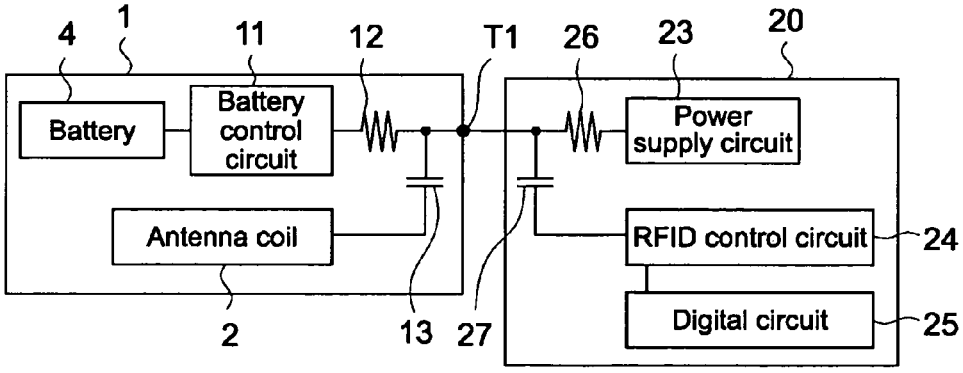

FIG. 14B is a block diagram showing the circuit configuration of the antenna module 1 and the electronic apparatus main body 20 in this example. As shown in FIG. 14B, the antenna module 1 includes, in addition to the battery 4 and the antenna coil 2, a battery control circuit 11, a resistor 12, and a capacitor 13. The electronic apparatus main body 20 includes a power supply circuit 23, an RFID control circuit 24, a digital circuit 25, a resistor 26, and a capacitor 27. It should be noted that the resistor 12 and the resistor 26 may be inductors, and that the resistance of the resistor (inductor) 12 and the resistor (inductor) 26 and the capacitance of the capacitor 13 and the capacitor 27 depend on a carrier frequency.

In the antenna module 1, the battery 4 is connected through the battery control circuit 11 and the resistor 12 to the terminal T1. The antenna coil 2 is connected through the capacitor 13 to the terminal T1. In the electronic apparatus main body 20, the power supply circuit 23 is connected through the resistor 26 to a terminal corresponding to the terminal T1, and the RFID control circuit 24 is connected through the capacitor 27 to a terminal corresponding to the terminal T1. Further, the RFID control circuit 24 is connected to the digital circuit 25.

When the antenna module 1 is connected to the electronic apparatus main body 20, the battery 4 supplies electric power through the battery control circuit 11 to the power supply circuit 23. Then, the power supply circuit 23 generates, from the electric power supplied from the battery 4, electric power to be used for driving the electronic apparatus main body 20. At this time, the resistor 12, the capacitor 13, the resistor 26, and the capacitor 27 function as low pass filters. The RFID control circuit 24 converts signals supplied from the digital circuit 25 into current for the antenna coil 2, or converts current supplied from the antenna coil 2 into digital signals. At this time, the resistor 12, the capacitor 13, the resistor 26, and the capacitor 27 function as high pass filters.

As described above, the antenna module 1 of this example supplies the electric power of the battery 4 to the electronic apparatus main body 20, and transmits and receives signals for the RFID with respect to the electronic apparatus main body 20, via the terminal T1.

[RFID System Example 3]

Figure 15A:
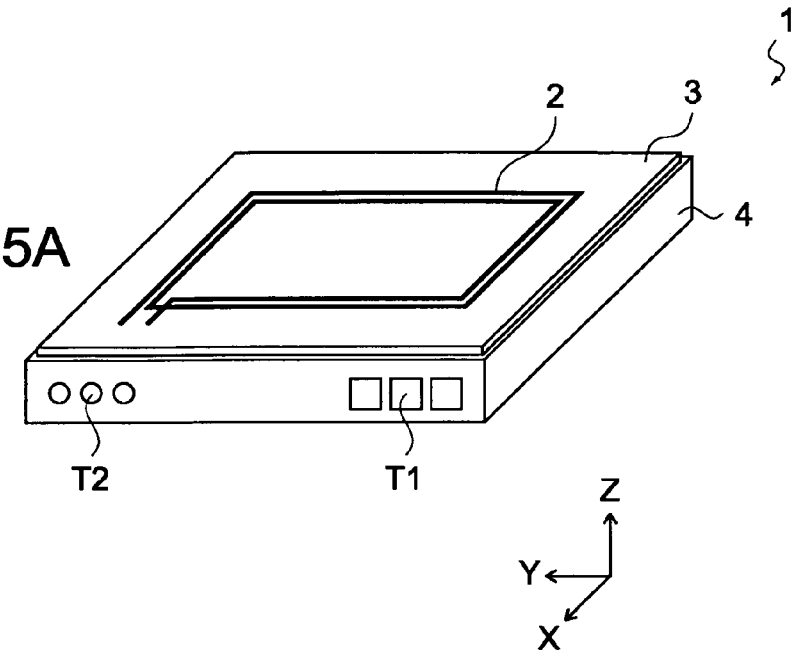
FIG. 15 are a perspective view showing an antenna module according to an RFID system example 3 and a block diagram showing a circuit configuration.

FIG. 15A is a perspective view showing the antenna module 1 in this example. As shown in FIG. 15A, the antenna module 1 is provided with a terminal T1 and a terminal T2.

Figure 15B:
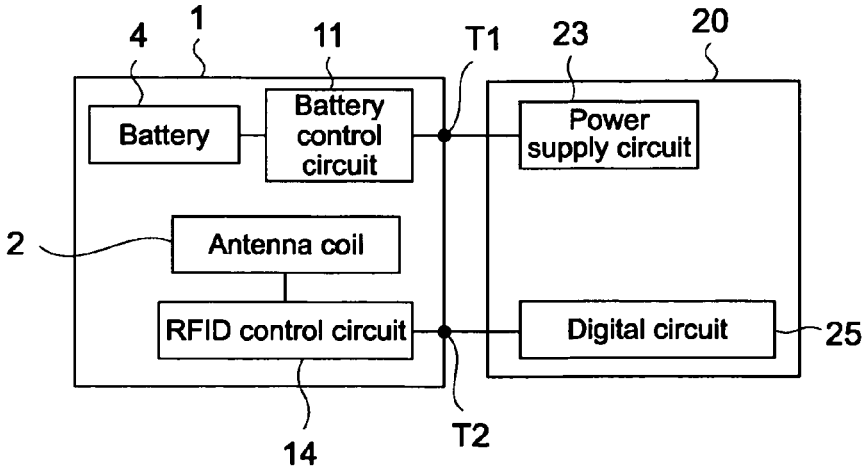

FIG. 15B is a block diagram showing the circuit configuration of the antenna module 1 and the electronic apparatus main body 20 in this example. As shown in FIG. 15B, the antenna module 1 includes, in addition to the battery 4 and the antenna coil 2, a battery control circuit 11 and an RFID control circuit 14. The electronic apparatus main body includes a power supply circuit 23 and a digital circuit 25.

In the antenna module 1, the battery 4 is connected through the battery control circuit 11 to the terminal T1. The antenna coil 2 is connected through the RFID control circuit 14 to the terminal T2. In the electronic apparatus main body 20, the power supply circuit 23 is connected to a terminal corresponding to the terminal T1, and the digital circuit 25 is connected to a terminal corresponding to the terminal T2.

When the antenna module 1 is connected to the electronic apparatus main body 20, the battery 4 supplies electric power through the battery control circuit 11 to the power supply circuit 23. Then, the power supply circuit 23 generates, from the electric power supplied from the battery 4, electric power to be used for driving the electronic apparatus main body 20. The RFID control circuit 14 converts signals supplied from the digital circuit 25 into current for the antenna coil 2, or converts current supplied from the antenna coil 2 into digital signals.

As described above, the antenna module 1 of this example supplies the electric power of the battery 4 via the terminal T1 to the electronic apparatus main body 20, and transmits and receives signals for the RFID with respect to the electronic apparatus main body 20 via the terminal T2.

[RFID System Example 4]

Figure 16A:
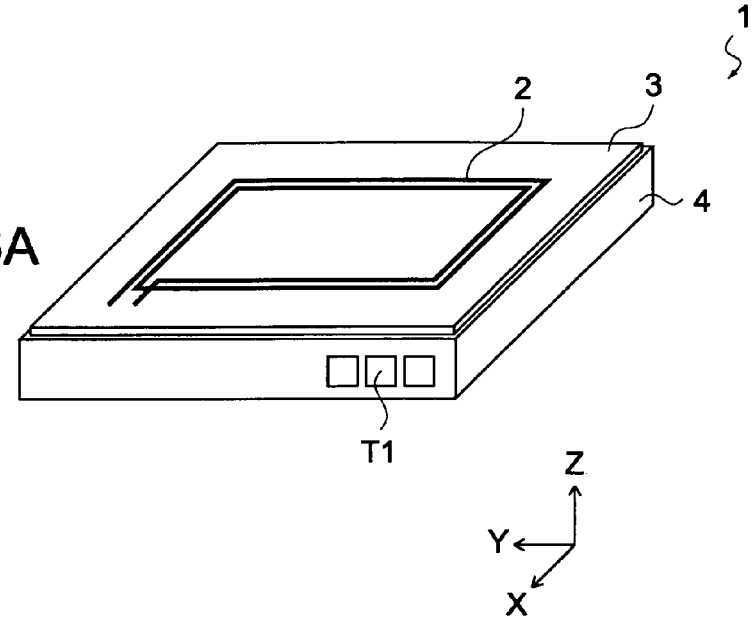
FIG. 16 are a perspective view showing an antenna module according to an RFID system example 4 and a block diagram showing a circuit configuration.

FIG. 16A is a perspective view showing the antenna module 1 in this example. As shown in FIG. 16A, the antenna module 1 is provided with a terminal T1.

Figure 16B:
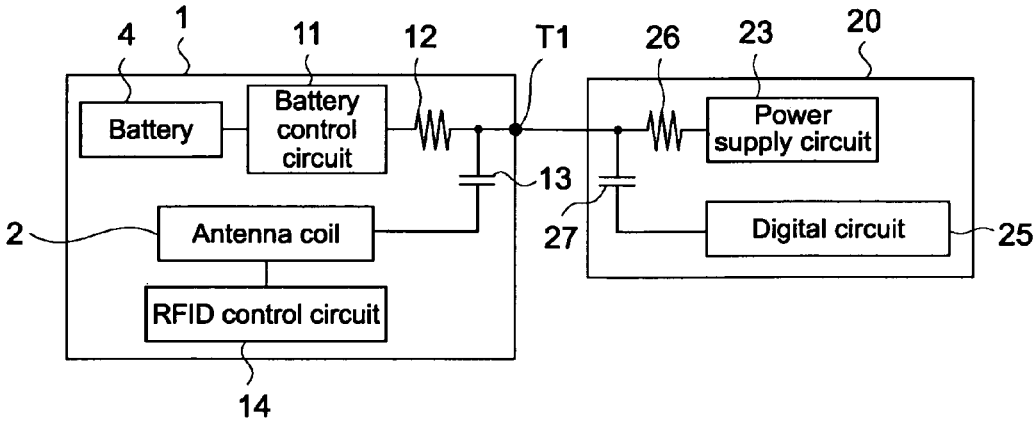

FIG. 16B is a block diagram showing the circuit configuration of the antenna module 1 and the electronic apparatus main body 20 in this example. As shown in FIG. 16B, the antenna module 1 includes, in addition to the battery 4 and the antenna coil 2, a battery control circuit 11, a resistor 12, a capacitor 13, and an RFID control circuit 14. The electronic apparatus main body 20 includes a power supply circuit 23, a digital circuit 25, a resistor 26, and a capacitor 27.

In the antenna module 1, the battery 4 is connected through the battery control circuit 11 and the resistor 12 to the terminal T1. The RFID control circuit 14 is connected through the antenna coil 2 and the capacitor 13 to the terminal T1. In the electronic apparatus main body 20, the power supply circuit 23 is connected through the resistor 26 to a terminal corresponding to the terminal T1. Further, the digital circuit 25 is connected through the capacitor 27 to a terminal corresponding to the terminal T1.

When the antenna module 1 is connected to the electronic apparatus main body 20, the battery 4 supplies electric power through the battery control circuit 11 to the power supply circuit 23. Then, the power supply circuit 23 generates, from the electric power supplied from the battery 4, electric power to be used for driving the electronic apparatus main body 20. At this time, the resistor 12, the capacitor 13, the resistor 26, and the capacitor 27 function as low pass filters. The RFID control circuit 14 converts signals supplied from the digital circuit 25 into current for the antenna coil 2, or converts current supplied from the antenna coil 2 into digital signals. At this time, the resistor 12, the capacitor 13, the resistor 26, and the capacitor 27 function as high pass filters.

As described above, the antenna module 1 of this example supplies the electric power of the battery 4 to the electronic apparatus main body 20, and transmits and receives signals for the RFID with respect to the electronic apparatus main body 20, via the terminal T1.

[Non-Contact Power Supply System Example 1]

Figure 17A:
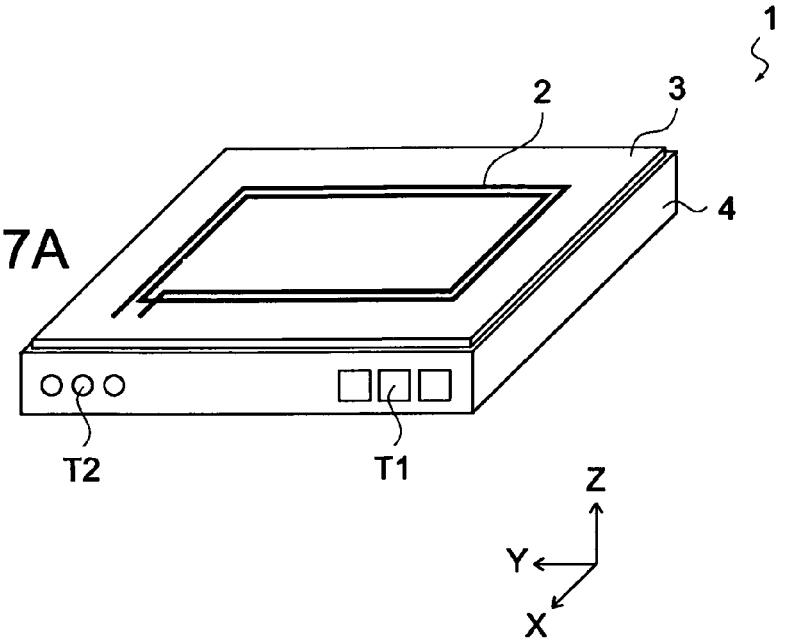
FIG. 17 are a perspective view showing an antenna module according to a non-contact power supply system 1 and a block diagram showing a circuit configuration.

FIG. 17A is a perspective view showing the antenna module 1 in this example. As shown in FIG. 17A, the antenna module 1 is provided with a terminal T1 and a terminal T2.

Figure 17B:
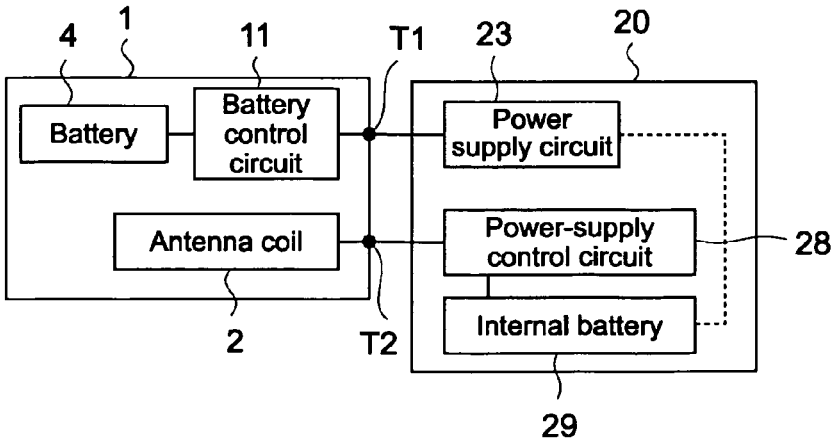

FIG. 17B is a block diagram showing a circuit configuration of the antenna module 1 and the electronic apparatus main body 20 in this example. As shown in FIG. 17B, the antenna module 1 includes, in addition to the battery 4 and the antenna coil 2, a battery control circuit 11. The electronic apparatus main body 20 includes a power supply circuit 23, a power-supply control circuit 28, and an internal battery 29.

In the antenna module 1, the battery 4 is connected through the battery control circuit 11 to the terminal T1, and the antenna coil 2 is connected to the terminal T2. In the electronic apparatus main body 20, the power supply circuit 23 is connected to a terminal corresponding to the terminal T1, and the power-supply control circuit 28 is connected to a terminal corresponding to the terminal T2. Further, the power-supply control circuit 28 is connected to the internal battery 29.

When the antenna module 1 is connected to the electronic apparatus main body 20, the battery 4 supplies electric power through the battery control circuit 11 to the power supply circuit 23, and the power supply circuit 23 generates, from the electric power supplied from the battery 4, electric power to be used for driving the electronic apparatus main body 20. The power-supply control circuit 28 supplies electric power supplied from the antenna coil 2 to the internal battery 29.

As described above, the antenna module 1 of this example supplies the electric power of the battery 4 to the electronic apparatus main body 20 via the terminal T1, and the electric power supplied by non-contact power supply is fed to the internal battery 29 via the terminal T2.

[Non-Contact Power Supply System Example 2]

Figure 18A:
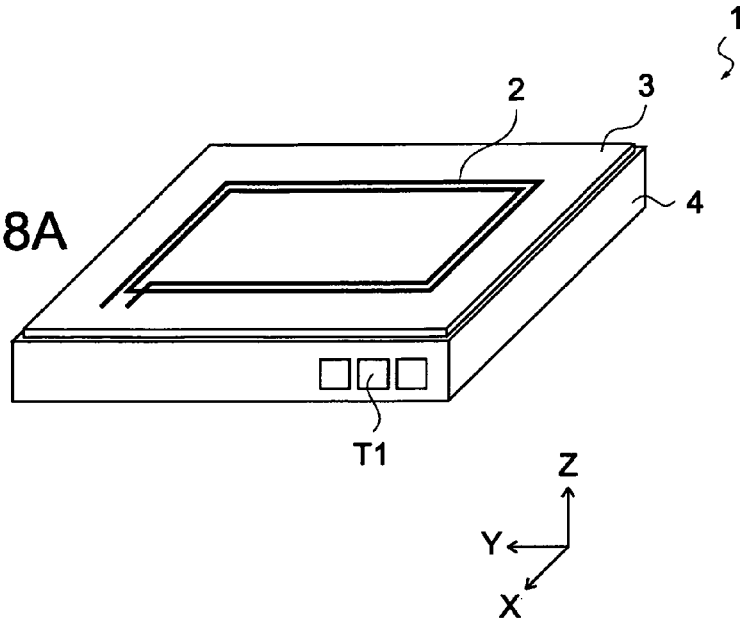
FIG. 18 are a perspective view showing an antenna module according to a non-contact power supply system 2 and a block diagram showing a circuit configuration.

FIG. 18A is a perspective view showing the antenna module 1 in this example. As shown in FIG. 18A, the antenna module 1 is provided with a terminal T1.

Figure 18B:
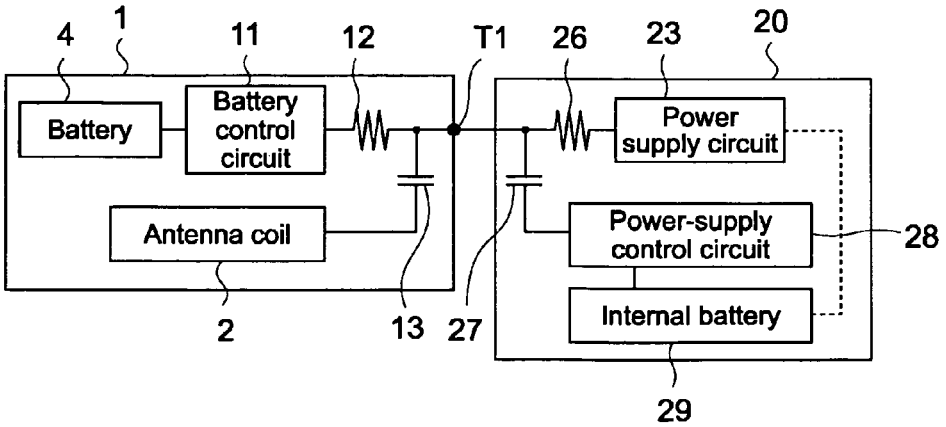

FIG. 18B is a block diagram showing a circuit configuration of the antenna module 1 and the electronic apparatus main body 20 in this example. As shown in FIG. 18B, the antenna module 1 includes, in addition to the battery 4 and the antenna coil 2, a battery control circuit 11, a resistor 12, and a capacitor 13. The electronic apparatus main body 20 includes a power supply circuit 23, a power-supply control circuit 28, an internal battery 29, a resistor 26, and a capacitor 27.

In the antenna module 1, the battery 4 is connected through the battery control circuit 11 and the resistor 12 to the terminal T1. The antenna coil 2 is connected through the capacitor 13 to the terminal T1. In the electronic apparatus main body 20, the power supply circuit 23 is connected through the resistor 26 to a terminal corresponding to the terminal T1, and the power-supply control circuit 28 is connected through the capacitor 27 to a terminal corresponding to the terminal T1. Further, the power-supply control circuit 28 is connected to the internal battery 29.

When the antenna module 1 is connected to the electronic apparatus main body 20, the battery 4 supplies electric power through the battery control circuit 11 to the power supply circuit 23, and the power supply circuit 23 generates, from the electric power supplied from the battery 4, electric power to be used for driving the electronic apparatus main body 20. At this time, the resistor 12, the capacitor 13, the resistor 26, and the capacitor 27 function as low pass filters. The power-supply control circuit 28 supplies electric power supplied from the antenna coil 2 to the internal battery 29. At this time, the resistor 12, the capacitor 13, the resistor 26, and the capacitor 27 function as high pass filters.

As described above, the antenna module 1 of this example supplies the electric power of the battery 4 to the electronic apparatus main body 20, and the electric power supplied by non-contact power supply is fed to the internal battery 29, via the terminal T1.

[Non-Contact Power Supply System Example 3]

Figure 19A:
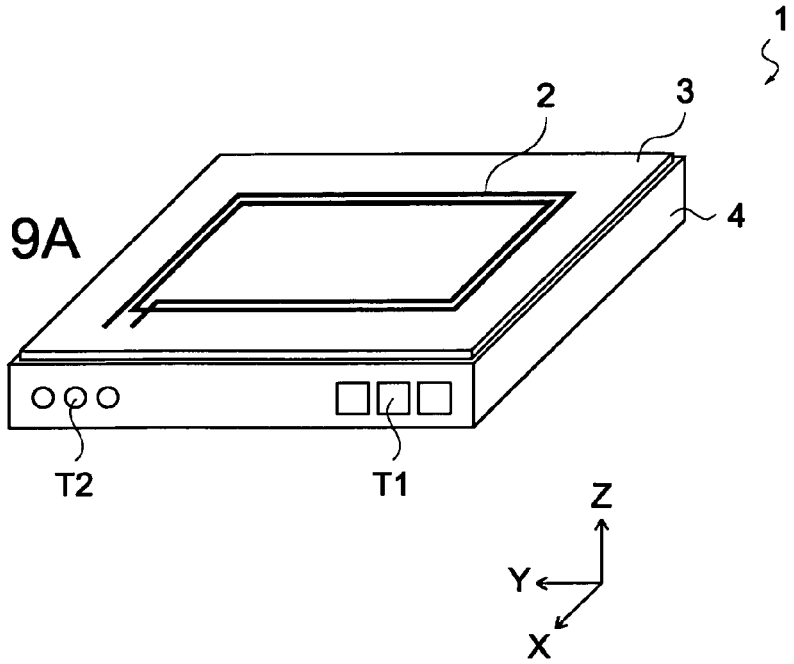
FIG. 19 are a perspective view showing an antenna module according to a non-contact power supply system 3 and a block diagram showing a circuit configuration.

FIG. 19A is a perspective view showing the antenna module 1 in this example. As shown in FIG. 19A, the antenna module 1 is provided with a terminal T1 and a terminal T2.

Figure 19B:
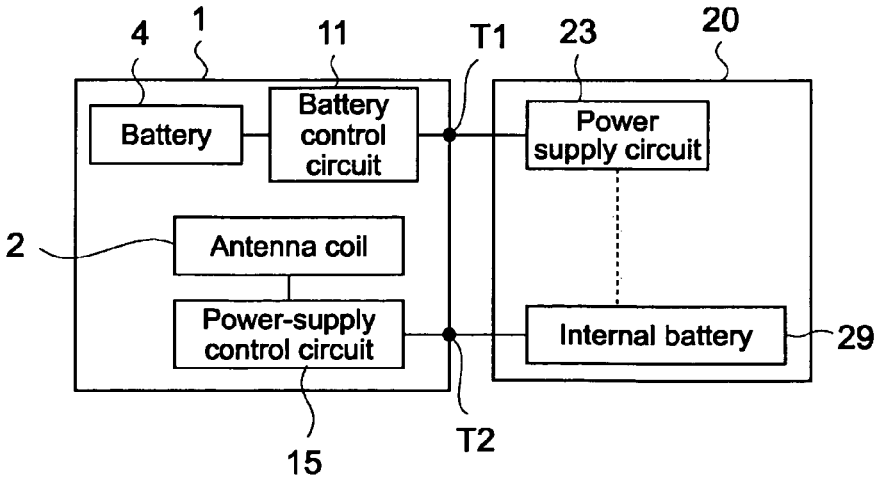

FIG. 19B is a block diagram showing a circuit configuration of the antenna module 1 and the electronic apparatus main body 20 in this example. As shown in FIG. 19B, the antenna module 1 includes, in addition to the battery 4 and the antenna coil 2, a battery control circuit 11 and a power-supply control circuit 15. The electronic apparatus main body 20 includes a power supply circuit 23 and an internal battery 29.

In the antenna module 1, the battery 4 is connected through the battery control circuit 11 to the terminal T1. The antenna coil 2 is connected through the power-supply control circuit 15 to the terminal T2. In the electronic apparatus main body 20, the power supply circuit 23 is connected to a terminal corresponding to the terminal T1, and the internal battery 29 is connected to a terminal corresponding to the terminal T2.

When the antenna module 1 is connected to the electronic apparatus main body 20, the battery 4 supplies electric power through the battery control circuit 11 to the power supply circuit 23, and the power supply circuit 23 generates, from the electric power supplied from the battery 4, electric power to be used for driving the electronic apparatus main body 20. The power-supply control circuit 15 supplies electric power supplied from the antenna coil 2 to the internal battery 29.

As described above, the antenna module 1 of this example supplies the electric power of the battery 4 to the electronic apparatus main body 20 via the terminal T1, and the electric power supplied by non-contact power supply is fed to the internal battery 29 via the terminal T2.

[Non-Contact Power Supply System Example 4]

Figure 20A:
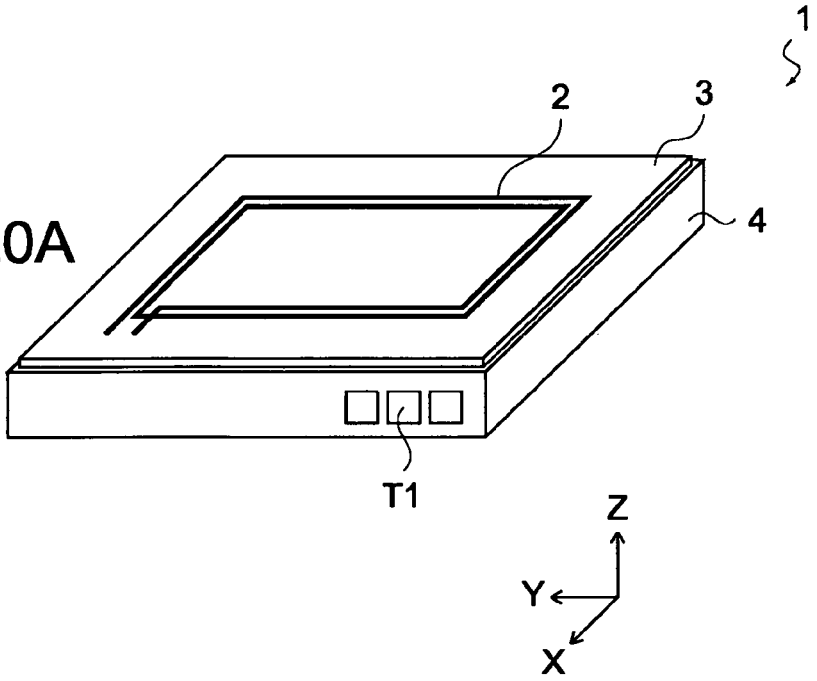
FIG. 20 are a perspective view showing an antenna module according to a non-contact power supply system 4 and a block diagram showing a circuit configuration.

FIG. 20A is a perspective view showing the antenna module 1 in this example. As shown in FIG. 20A, the antenna module 1 is provided with a terminal T1.

Figure 20B:
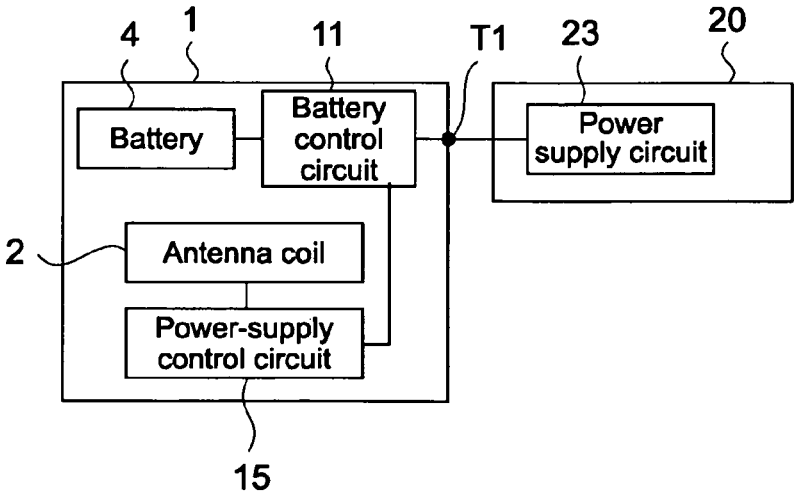

FIG. 20B is a block diagram showing a circuit configuration of the antenna module 1 and the electronic apparatus main body 20 in this example. As shown in FIG. 20B, the antenna module 1 includes, in addition to the battery 4 and the antenna coil 2, a battery control circuit 11 and a power-supply control circuit 15. The electronic apparatus main body 20 includes a power supply circuit 23.

In the antenna module 1, the battery 4 is connected through the battery control circuit 11 to the terminal T1, and the antenna coil 2 is connected through the power-supply control circuit 15 to the battery control circuit 11. In the electronic apparatus main body 20, the power supply circuit 23 is connected to a terminal corresponding to the terminal T1.

When the antenna module 1 is connected to the electronic apparatus main body 20, the battery 4 supplies electric power through the battery control circuit 11 to the power supply circuit 23, and the power supply circuit 23 generates, from the electric power supplied from the battery 4, electric power to be used for driving the electronic apparatus main body 20. The power-supply control circuit 15 supplies electric power, which is supplied from the antenna coil 2, through the battery control circuit 11 to the battery 14.

As described above, the antenna module 1 of this example supplies the electric power of the battery 4 to the electronic apparatus main body 20 via the terminal T1, and the electric power supplied by non-contact power supply is supplied to the battery 4 via the terminal T2.

[Non-Contact Power Supply System Example 5]

Figure 21A:
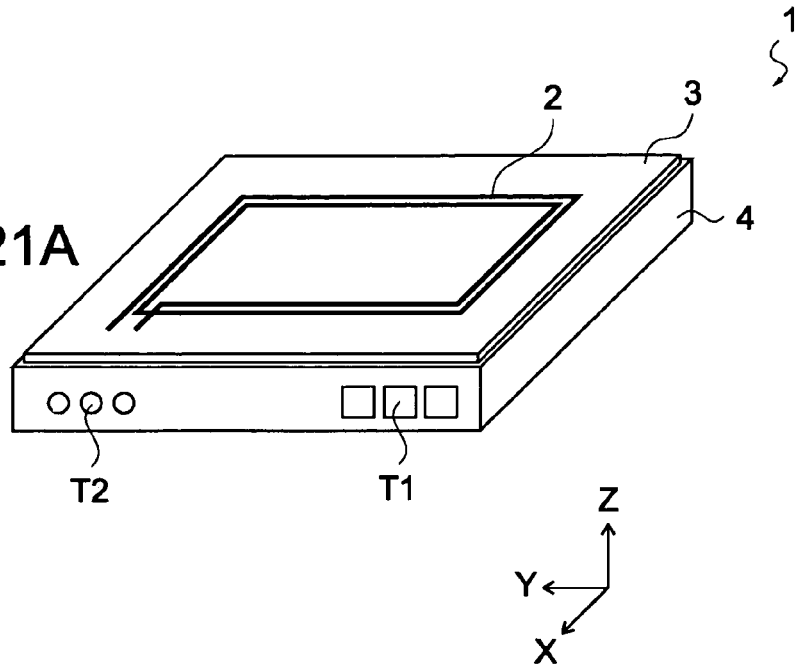
FIG. 21 are a perspective view showing an antenna module according to a non-contact power supply system 5 and a block diagram showing a circuit configuration.

FIG. 21A is a perspective view showing the antenna module 1 in this example. As shown in FIG. 21A, the antenna module 1 is provided with a terminal T1 and a terminal T2.

Figure 21B:
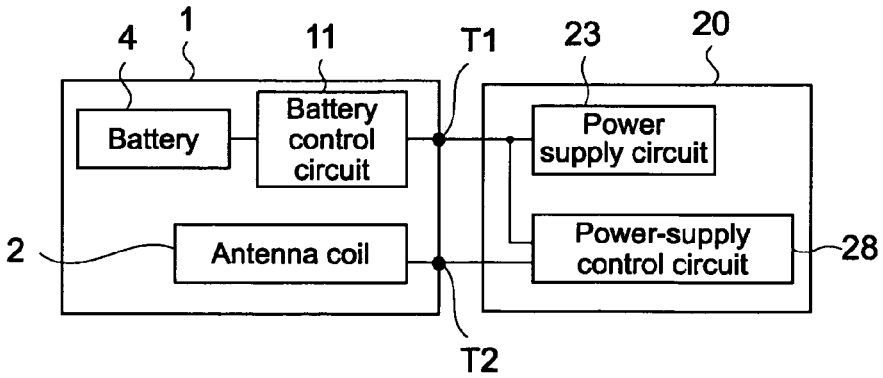

FIG. 21B is a block diagram showing a circuit configuration of the antenna module 1 and the electronic apparatus main body 20 in this example. As shown in FIG. 21B, the antenna module 1 includes, in addition to the battery 4 and the antenna coil 2, a battery control circuit 11. The electronic apparatus main body 20 includes a power supply circuit 23 and a power-supply control circuit 28.

In the antenna module 1, the battery 4 is connected through the battery control circuit 11 to the terminal T1. The antenna coil 2 is connected to the terminal T2. In the electronic apparatus main body 20, the power supply circuit 23 is connected to a terminal corresponding to the terminal T1. The power-supply control circuit 28 is connected to a terminal corresponding to the terminal T2 and to a terminal corresponding to the terminal T1.

When the antenna module 1 is connected to the electronic apparatus main body 20, the battery 4 supplies electric power through the battery control circuit 11 to the power supply circuit 23, and the power supply circuit 23 generates, from the electric power supplied from the battery 4, electric power to be used for driving the electronic apparatus main body 20. The power-supply control circuit 28 supplies electric power, which is supplied from the antenna coil 2, through the battery control circuit 11 to the internal battery 29.

As described above, the antenna module 1 of this example supplies the electric power of the battery 4 to the electronic apparatus main body 20 via the terminal T1, and the electric power supplied by non-contact power supply is supplied to the battery 4 via the terminal T1.

[Non-Contact Power Supply System Example 6]

Figure 22A:
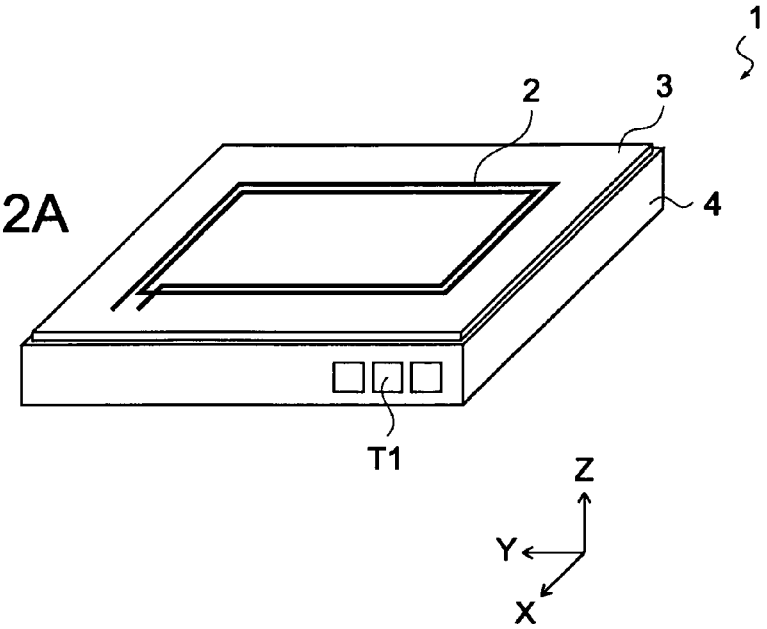
FIG. 22 are a perspective view showing an antenna module according to a non-contact power supply system 6 and a block diagram showing a circuit configuration.

FIG. 22A is a perspective view showing the antenna module 1 in this example. As shown in FIG. 22A, the antenna module 1 is provided with a terminal T1.

Figure 22B:
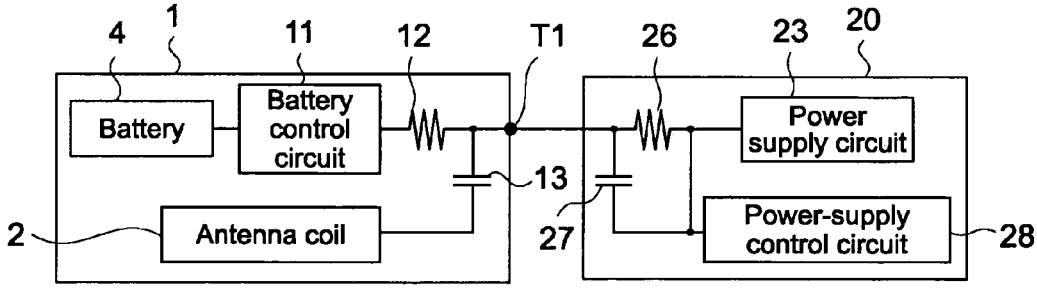

FIG. 22B is a block diagram showing a circuit configuration of the antenna module 1 and the electronic apparatus main body 20 in this example. As shown in FIG. 22B, the antenna module 1 includes, in addition to the battery 4 and the antenna coil 2, a battery control circuit 11, a resistor 12, and a capacitor 13. The electronic apparatus main body 20 includes a power supply circuit 23, a power-supply control circuit 28, a resistor 26, and a capacitor 27.

In the antenna module 1, the battery 4 is connected through the battery control circuit 11 and the capacitor 12 to the terminal T1. The antenna coil 2 is connected through a capacitor 13 to the terminal T1. In the electronic apparatus main body 20, the power supply circuit 23 is connected through the resistor 26 to a terminal corresponding to the terminal T1, and the power-supply control circuit 28 is connected through the capacitor 27 to a terminal corresponding to the terminal T1 and through the resistor 26 to a terminal corresponding to the terminal T1.

When the antenna module 1 is connected to the electronic apparatus main body 20, the battery 4 supplies electric power through the battery control circuit 11 to the power supply circuit 23, and the power supply circuit 23 generates, from the electric power supplied from the battery 4, electric power to be used for driving the electronic apparatus main body 20. At this time, the resistor 12, the capacitor 13, the resistor 26, and the capacitor 27 function as low pass filters. The power-supply control circuit 28 supplies electric power supplied from the antenna coil 2 to the battery 4. When the electric power is supplied from the antenna coil 2 to the power-supply control circuit 28, the resistor 12, the capacitor 13, the resistor 26, and the capacitor 27 function as high pass filters. Further, when the electric power is supplied from the power-supply control circuit 28 to battery 4, the resistor 12, the capacitor 13, the resistor 26, and the capacitor 27 function as low pass filters.

As described above, the antenna module 1 of this example supplies the electric power of the battery 4 to the electronic apparatus main body 20, and the electric power supplied by non-contact power supply is fed to the battery 4, via the terminal T1.

The present invention is not limited to the above-mentioned embodiments, and can be modified without departing from the gist of the present invention. Although in the above-mentioned embodiments, the battery is used as the conductor for preventing the interference of the metal located in the periphery of the antenna module with respect to the antenna coil, it is also possible to use a conductor other than the battery. In this case, the conductor can have a size large enough to shut out the interference due to the metal part provided to the electronic apparatus with respect to the antenna coil. A shield plate for electromagnetic compatibility (EMC) provided to the electronic apparatus can be exemplified as the above-mentioned conductor.

It should be understood by those skilled in the art that various modifications, combinations, sub-combinations and alterations may occur depending on design requirements and other factors insofar as they are within the scope of the appended claims or the equivalents thereof.

What is claimed is:

1. An antenna module, comprising:

an antenna coil having a first pattern width;

a magnetic sheet, which includes a first surface on which the antenna coil is to be arranged, and has a first distance being a distance on the first surface between an edge of the first surface and the antenna coil, the first distance being twice or more as large as the first pattern width such that the first surface of the magnetic sheet is larger in a direction corresponding to the first distance than that of the antenna coil; and a conductor, which includes a second surface on which the magnetic sheet is to be arranged while a surface opposite to the first surface of the magnetic sheet faces the second surface, and has a second distance being a distance on the second surface between an edge of the second surface and the antenna coil, the second distance being equal to or larger than the first distance.

2. The antenna module according to claim 1, wherein the conductor includes a battery.

3. The antenna module according to claim 2, wherein the first distance is 4 times or more as large as the first pattern width.

4. The antenna module according to claim 3, wherein the antenna coil includes an antenna coil for radio frequency identification.

5. The antenna module according to claim 3, wherein the antenna coil includes an antenna coil for non-contact power transmission.

6. An electronic apparatus, comprising:

an antenna module including an antenna coil having a first pattern width, a magnetic sheet, which includes a first surface on which the antenna coil is to be arranged, and has a first distance being a distance on the first surface between an edge of the first surface and the antenna coil, the first distance being twice or more as large as the first pattern width such that the first surface of the magnetic sheet is larger in a direction corresponding to the first distance than that of the antenna coil, and a conductor, which includes a second surface on which the magnetic sheet is to be arranged while a surface opposite to the first surface of the magnetic sheet faces the second surface, and has a second distance being a distance on the second surface between an edge of the second surface and the antenna coil, the second distance being equal to or larger than the first distance; and an electronic apparatus main body in which the antenna module is to be installed.

7. The electronic apparatus according to claim 6, wherein the conductor includes a battery, and the electronic apparatus main body is driven by the battery.

* * * * *